United States Patent [19]

Ozeki

[11] Patent Number: 4,997,089

[45] Date of Patent: Mar. 5, 1991

[54] FILE SHEET DUST COVERS

[75] Inventor: Jiro Ozeki, Tokyo, Japan

[73] Assignee: Slidex Corporation, Tokyo, Japan

[21] Appl. No.: 355,456

[22] Filed: May 19, 1989

[30] Foreign Application Priority Data

May 19, 1988 [JP] Japan ..... 63-65093

[51] Int. Cl.[5] ..... B65D 85/00

[52] U.S. Cl. ..... 206/455; 40/405; 206/311; 383/87; 402/75; 402/79

[58] Field of Search ..... 40/159.2, 405; 383/86, 383/87; 206/455, 311; 229/1.5 R; 402/75, 79

[56] References Cited

U.S. PATENT DOCUMENTS

| | | | |
|---|---|---|---|
| 1,098,154 | 5/1914 | Housh | 206/311 |
| 1,807,467 | 5/1931 | Bonander | 40/405 |
| 3,277,598 | 10/1966 | Lightburn | 40/159.2 |
| 3,555,713 | 1/1971 | Leinbach | 40/405 |
| 4,193,218 | 3/1980 | Mermelstein | 40/159.2 |
| 4,202,122 | 5/1980 | Namiki | 40/405 |
| 4,533,049 | 8/1985 | Ozeki | 206/455 |
| 4,704,042 | 11/1987 | Eisen et al. | 206/455 |

FOREIGN PATENT DOCUMENTS

| | | | |
|---|---|---|---|
| 980193 | 5/1951 | France | 206/311 |
| 2305308 | 10/1976 | France | 402/79 |
| 61-35869 | 2/1986 | Japan . | |
| 144340 | 12/1930 | Switzerland | 206/311 |
| 341013 | 10/1959 | Switzerland | 206/311 |
| 878982 | 10/1961 | United Kingdom | 40/159.2 |

*Primary Examiner*—Stephen P. Garbe

*Attorney, Agent, or Firm*—Fleit, Jacobson, Cohn, Price, Holman & Stern

[57] ABSTRACT

A file sheet dust cover comprises a plastic bag having a file-insertion type inlet opening, and flap joined to the plastic bag. The inlet opening allows insertion of a file sheet into the plastic bag. The flap is adapted to cover a portion of the file sheet projecting outside from the inlet opening, and a plurality of binder holes or cuts are provided in a bottom portion of the plastic bag such that when the file sheet is inserted into the plastic bag, the binder holes or cuts conform with a part or an entire part of a plurality of corresponding binder holes formed in the file sheet. A joined edge between the flap and the plastic bag is extended outwardly toward the inlet opening at opposite side ends of the plastic bag.

5 Claims, 4 Drawing Sheets

FILE SHEET DUST COVERS

BACKGROUND OF THE INVENTION (1) Field of the Invention

The present invention relates to a file sheet dust cover for housing and protecting a file sheet. More particularly, the invention relates to a file sheet dust cover for effectively preventing damages of thin samples, such as films or preparations, inserted and held in such a file sheet, and also attachment of dusts thereonto.

(2) Related Art Statement

Formerly, Slidex Corporation has proposed dust covers of this type, for instance, in Japanese Utility Model Registration Application Laid-open No. 61-35,869.

In such a dust cover, an inlet opening is formed at one side edge of light-transmitting plastic films by sealing the films at the remaining three sides. These films cover opposite surfaces of a file sheet, respectively. When the file sheet is completely inserted into the dust cover through the inlet opening, the dust cover can protect the file sheet, in its turn, slide films held by the file sheet, from damages, and attachment of dusts.

However, since such a prior art technique has the inlet opening at one side edge of the dust cover, there are problems in that the file sheet is likely to slip off from the dust cover during handling of the cover after the file sheet is received therein, and that dusts are ready to enter the dust cover.

SUMMARY OF THE INVENTION

It is an object of the present invention to advantageously solve the problems encountered by the prior art, and to provide a file sheet dust cover capable of fully preventing accidental slipping off of a file sheet from the dust cover and extremely effectively preventing invasion of dusts thereinto.

According to the dust cover of the present invention, a plastic bag is provided with a file-insertion type inlet opening for allowing insertion of a file sheet into the bag. A flap is joined to the plastic bag for covering a portion of the file sheet projecting outside from the inlet opening of the bag, while joined edge between the flap and the plastic bag is extended outwardly toward the inlet opening at opposite side portions of the plastic bag. A plurality of binder holes or cuts are provided in a bottom portion of the plastic bag in such a manner that the binder holes or cuts may correspond to a part or an entire part of a plurality of binder holes formed in the file sheet when the file sheet is inserted into the plastic bag.

According to the dust cover of the present invention, after the file sheet is completely inserted into the plastic bag through the insertion type inlet opening, a portion of the file sheet projecting outside from the inlet opening is completely covered with the flap. Consequently, the file sheet can be almost completely prevented from accidentally slipping off from the dust cover by contacting the file sheet with the joined portion between the plastic bag and the flap. Furthermore, dusts can extremely effectively be prevented from entering the dust cover by closing the inlet opening with the flap.

In addition, the joined edge of the flap and the plastic bag is extended outwardly toward the inlet opening of the plastic bag on the opposite side portions. When the file sheet is inserted into the dust cover and then the inlet opening is closed with the flap, corners of a portion of the file sheet projecting outside from the inlet opening are centered widthwise of the dust cover due to action of the joined edge contacting them. Thus, even when the inlet opening is made sufficiently wider than the file sheet to facilitate an insertion operation of the file sheet into the plastic bag, the file sheet can always appropriately be located in the central portion widthwise of the plastic bag. As a result, the binder holes formed in the file sheet are accurately in conformity with the binder hole or cuts formed in the bottom portion of the plastic bag, so that the dust cover in which the file sheet is received can extremely easily be bound by a binder.

These and other objects, features and advantages of the invention will be appreciated upon reading of the following description of the invention when taken in conjunction with the attached drawings, with the understanding that the some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

DETAILED DESCRIPTION OF THE INVENTION

Now, the present invention will be explained in more detail with reference to the attached drawings.

Figure 1:
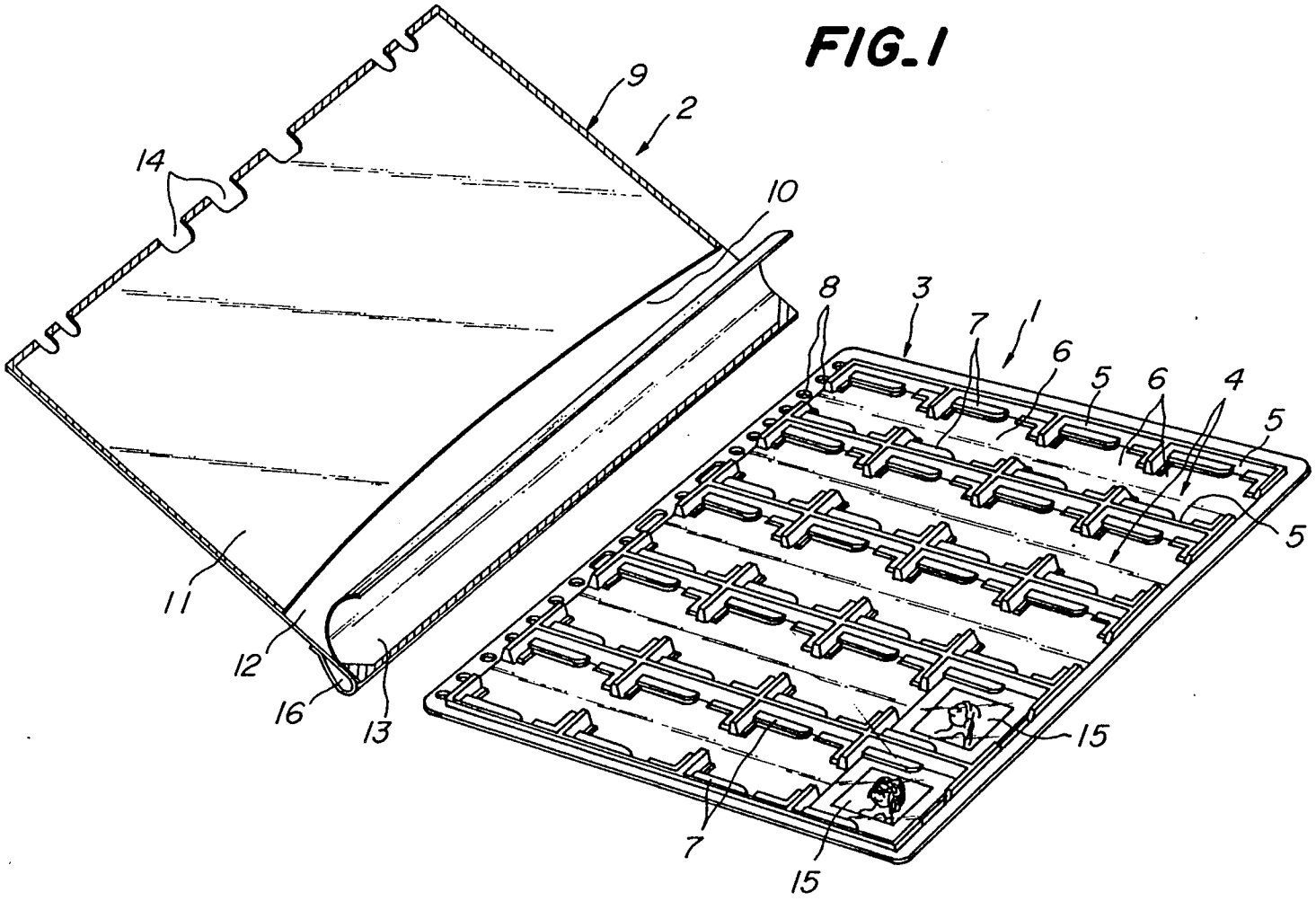
FIG. 1 is a perspective view of an embodiment of the dust cover according to the present invention together with a file sheet.

FIG. 1 shows an embodiment of the present invention. In FIG. 1, reference numerals 1 and 2 denote a file sheet onto which mount-attached slide films are to be arrayed and held as an example of thin samples in a matrix fashion, and a dust cover for receiving and protecting such a file sheet 1, respectively. The dust cover has preferably light transmittability.

In the file sheet 1, a plurality of square recesses 4, which serve as portions for receiving films, are arrayed in a transparent or lactescent planar square plastic sheet 3. Hold pieces 7, 7 are projected inside each of the square recesses 4 from its opposite side walls 5 by cutting a bottom wall 6 and raising the cut portions up. Nineteen binder holes 8 are provided in and along a given one side of the plastic sheet 3.

One end of each of the hold pieces 7, which are provided along the opposite side walls 5 of the square recess 4 while extending therealong, continues to one of end walls of the recess 4, while the other end extends slightly over the central portion of the opposite side wall 5.

On the other hand, the dust covers 2 of this embodiment generally comprises a plastic bag 9 constituted by sealing two plastic films on three sides as shown in FIG. 1 by shadowed portions, and an insertion type inlet opening 10 for allowing insertion of the file sheet 1 into the plastic bag 9, i.e., the inlet opening formed by terminating the front side member 11 of the plastic bag 9 midway the rear side member 12 in an inserting direction of the file sheet 1. Further, one side edge portion of a flap 13 is joined to the plastic bag 9, in its turn, a side edge of a portion of the rear side member 12 spaced from a bottom portion of the plastic bag such that the joined portion may be of an almost U-shaped fashion opened to the inlet opening 10 as also shown in FIG. 1 by a shadowed portion. By so constructing, the flap can freely be opened or closed.

Figure 2:
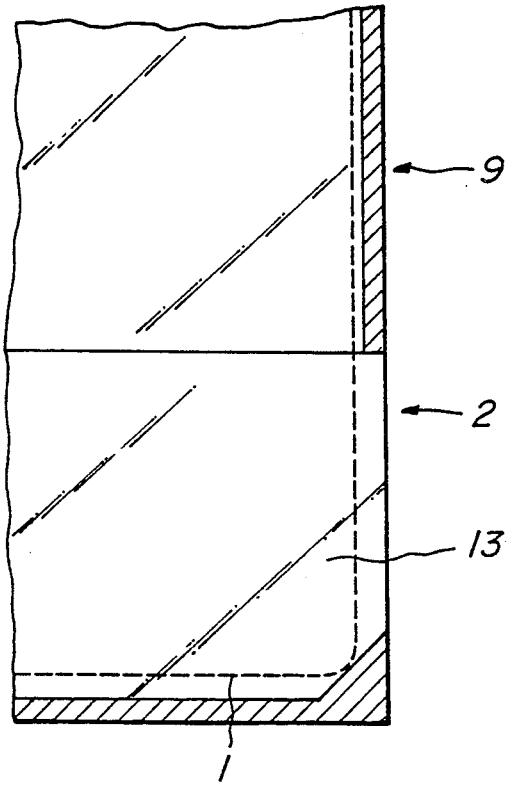
FIG. 2 is a partially sectional view for illustrating a part of a joined edge between a flap and a plastic bag.

As shown in an enlarged view of a principal portion in FIG. 2, the joined edge between the flap 13 and the plastic bag 9 has opposite side edges of an inclined shape widened outwardly toward the side of inlet opening. Owing to this, when the flap is closed, the file sheet 1 inserted into the plastic bag 9 can be centered in a central portion in the widthwise direction of the plastic bag 9 while the corners of the file sheet contact the widened side portions of the joined edge.

Further, in order to effectively prevent invasion of dusts through the inlet opening 10, a portion of the flap 13 projecting toward the inlet opening side is set in such a length that the flap reaches at least an edge of the inlet opening, in other words, it reaches at least the nearer side edge of the front side member.

Moreover, in this embodiment, a bottom portion of the plastic bag 9 is formed with a plurality of cuts 14 which correspond a part of the binder holes 8 formed in the file sheet 1 so that the plastic bag 9, in its turn, the file sheet 1 received in the dust cover may be bound together with the dust cover 2 in an album fashion by means of metal fixing pins. As a matter of course, the cuts shown may be replaced by binder holes. The cuts or binder holes 14 may be provided corresponding to the entire binder holes 8 formed in the file sheet 1.

It is preferable that the rear side member 12 of the plastic bag 9 is folded back toward the rear side at a side portion other than the one provided with the cuts 14. Because, in this case, a hanging bar can be inserted into a folded back portion to support the file sheet 1 together with the file cover in a hanged state.

In the above-illustrated dust cover 2, when the front and rear side members 11 and 12 are formed from a transparent material and a lactescent material, respectively, diffused light rays passing through the lactescent material can effectively be utilized to illuminate images of mount-attached slide films 15 held in the file sheet 1 from the back side in the case that the images are intended to be preliminarily viewed or checked.

Figures 3A, 3B, 3C, 3D:
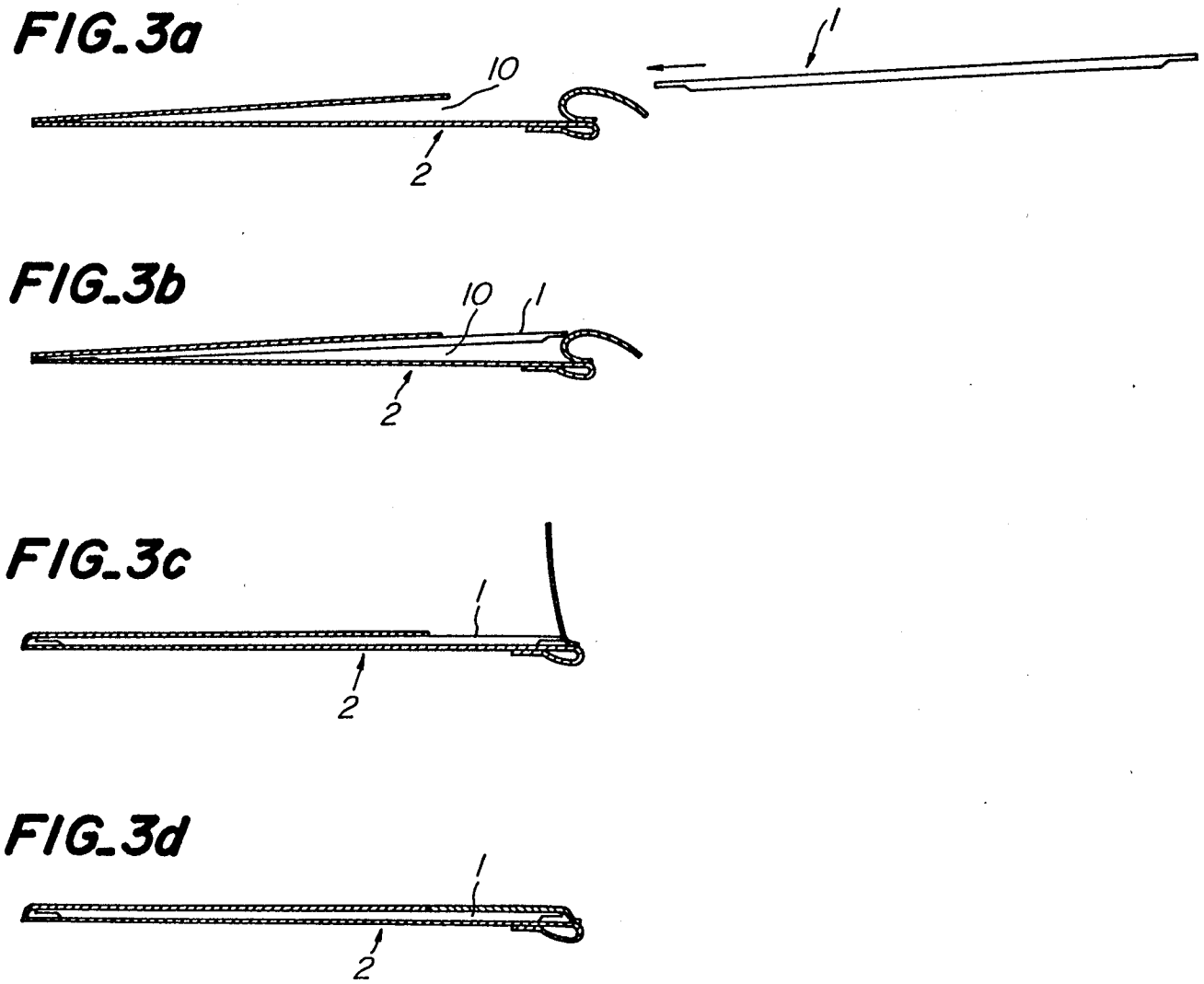
FIGS. 3*a* through 3*d* are views for illustrating steps of inserting the file sheet into the dust cover.

When the dust cover 2 is to be used, as shown in FIG. 3*a*, the flap 13 is first opened, and the file sheet 1 in which the mount-attached slide films 15 are placed and held is inserted into the plastic bag 9 through the inlet opening 10. After a most part of the file sheet 1 is inserted into the plastic bag as shown in FIG. 3*b*, the file sheet 1 is further advanced inside the plastic bag by the flap 13 through raising up the free end of the flap 13 in a closing direction. By so doing, when the file sheet 1 reaches sufficiently near the advancement-terminated location, as partially shown in FIG. 2 in an enlarged scale, the corners of the file sheet 1 projecting outside through the inlet opening 10 contact the widened opposite joined ends between the flap 13 and the plastic bag 9 so that the file sheet 1 is moved to the widthwisely central portion of the plastic sheet 9.

After the file sheet is completely inserted in this manner, the flap is completely shut as shown in FIG. 3*d*. Thereby, insertion of the file sheet 1 into the dust cover 2 is terminated.

In the above embodiment, even when the dust cover is positioned in such a posture during the handling of the dust cover 2, that the flap faces downwardly, the file sheet 1 inserted into the dust cover 2 is almost completely prevented from accidentally slipping off from the cover 2, since the side edges of the file sheet 1 contact the joined portion between the flap 13 and the plastic sheet 1. In addition, dusts can extremely effectively be prevented from entering the dust cover, because the tip end surface of the flap 13 contacts the end surface of the front side member of the plastic bag 9.

Figure 4:
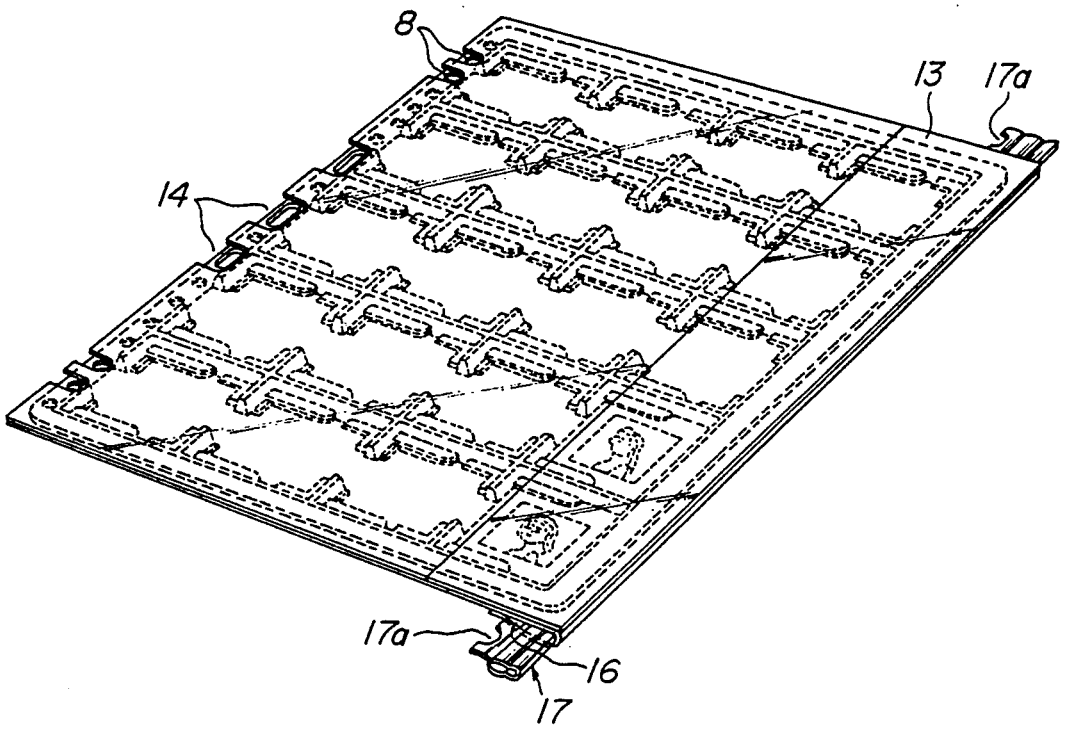
FIG. 4 is a perspective view of the dust cover into which the file sheet is completely held.

Furthermore, in this embodiment, since the joined edge between the flap 13 and the plastic bag 9 is widened outwardly on the opposite sides toward the inlet opening, the file sheet 1 can be centered widthwise with respect to the dust cover 2 when the flap 13 is closed. Therefore, when the file sheet 1 is completely placed into the dust cover 2, as shown in FIG. 4, the binder holes 8 of the file sheet 1 can accurately be conformed with the cuts 14 of the dust cover 2, even if the dust cover has a width large enough to provide a sufficient play to the file sheet 1. Therefore, when the file sheet 1 is to be bound together with the dust cover 2 by means of metal fixing members not shown, tip ends of pawls of the fixing members can extremely easily be advanced through the binder holes 8.

When the dust cover is provided with the hanging bar-inserting portion 16, a hanging bar 17 having a hook 17*a* is passed through the inserting portion 16 as shown in FIG. 4, so that the dust cover 2 can be hanged and supported by a rail or the like provided at a drawer of a cabinet while housing the file sheet 1.

Although the present invention has been explained above on the basis of the specific embodiments, the file sheet may be ones in which thin samples such as preparations, dental films or the like are inserted and held.

As mentioned above, according to the present invention, the file sheet can almost completely be prevented from accidentally slipping off from the dust cover, and dusts can extremely effectively be prevented from entering the dust cover. As a result, thin samples held in the file sheet can sufficiently be protected against damages and contamination.

Further, according to the present invention, when the joined edge between the flap and the plastic bag includes widened joined edges opened toward the inlet opening at the opposite side end portions, the file sheet can be centered in the widthwise direction of the dust cover in the case that the flap is closed. Thereby, the binder holes 8 can always accurately be conformed with the cuts of the dust cover 2.

What is claimed is:

1. A file sheet dust cover comprising:

a plastic bas having a file-insertion inlet opening for allowing insertion of a file sheet thereinto, a flap joined to said plastic bag, said flap being adapted to cover a portion of the file sheet projecting outside from the inlet opening, a plurality of openings provided in a bottom portion of the plastic bag, said openings corresponding to at least a part of a plurality of binder holes formed in the file sheet, and edges of the flap and the plastic bag being joined together and extending along a side opposite to the bottom portion of the plastic bag, each of opposite ends of the joined edges of the flap and the plastic bag have a wider width than a central portion of the joined edges and the opposite ends extend outwardly toward the inlet opening at the opposite ends for centering the file sheet widthwise due to contact with the edges upon closing of said flap.

2. The dust cover according to claim 1, wherein a rear side member of the plastic bag is folded back toward a rear side of said rear side member at a side portion.

3. The dust cover according to claim 1, wherein front and rear side members of the plastic bag are formed from a transparent material and a lactescent material, respectively.

4. The dust cover according to claim 1, wherein a plastic bag is formed by sealing front and rear side plastic films on three sides, and the inlet opening is formed by terminating the front side member of the plastic bag midway the rear side member in an inserting direction of the file sheet.

5. The dust cover according to claim 1, wherein a portion of the flap projects toward the inlet opening side and is of a length that the flap reaches at least an edge of the inlet opening.

* * * * *